US011248877B2

(12) United States Patent
Jonassen et al.

(10) Patent No.: US 11,248,877 B2
(45) Date of Patent: Feb. 15, 2022

(54) ANTIBALLISTIC PANEL ARRANGED FOR OPTICAL INSPECTION AND METHOD THEREOF

(71) Applicant: Missingen Services AS, Kråkerøy (NO)

(72) Inventors: Tom Jonassen, Manstad (NO); Pål Francis Hansen, Vesterøy (NO)

(73) Assignee: MISSINGEN SERVICES AS, Kråkerøy (NO)

( * ) Notice: Subject to any disclaimer, the term of this patent is extended or adjusted under 35 U.S.C. 154(b) by 0 days.

(21) Appl. No.: 17/016,780

(22) Filed: Sep. 10, 2020

(65) Prior Publication Data

US 2021/0180919 A1 Jun. 17, 2021

(30) Foreign Application Priority Data

Sep. 11, 2019 (NO) ..... 20191092

(51) Int. Cl.
*F41H 5/04* (2006.01)

(52) U.S. Cl.
CPC ..... *F41H 5/0435* (2013.01)

(58) Field of Classification Search
None
See application file for complete search history.

(56) References Cited

U.S. PATENT DOCUMENTS 4,917,938 A 4/1990 Mohan
H1519 H 3/1996 Semple
7,730,548 B1 6/2010 McCraney
7,849,779 B1 * 12/2010 Hansen ..... F41H 5/0435 89/36.02
7,878,140 B1 2/2011 Steele et al.
2012/0177177 A1 7/2012 Masters
2012/0269995 A1 10/2012 Leighton et al.
2018/0229480 A1 8/2018 Chung
2019/0056204 A1 2/2019 Field

FOREIGN PATENT DOCUMENTS

WO WO 2019/064277 A1 4/2019

OTHER PUBLICATIONS

Lee, "PEO Soldier Armored Plate Tap Test—Training," DVIDS, URL:https://www.dvids.net/video/473427/peo-soldier-armored-plate-tap-test-training, Jan. 7, 2016, 4 pages.
Norwegian Search Report for Norwegian Application No. 20191092, dated Mar. 31, 2020, with English translation.
International Search Report for International Application No. PCT/NO2020/050231, dated Dec. 10, 2020.

* cited by examiner

*Primary Examiner* — Reginald S Tillman, Jr.
(74) *Attorney, Agent, or Firm* — Birch, Stewart, Kolasch & Birch, LLP

(57) ABSTRACT

An optically detectable antiballistic plate, and a method of producing it are disclosed. The antiballistic plate includes a core of a ceramic plate, coated with a transparent fibre-reinforced surface composite layer of plastic matrix and reinforcement fibre. Cracks visible to the human eye in daylight will occur, in the event of damage to the ceramic plate.

20 Claims, 4 Drawing Sheets imagined section B-B of Fig. 1, enlarged, along the antiballistic plate according to an embodiment of the invention (trauma reducing backing (3) not shown)

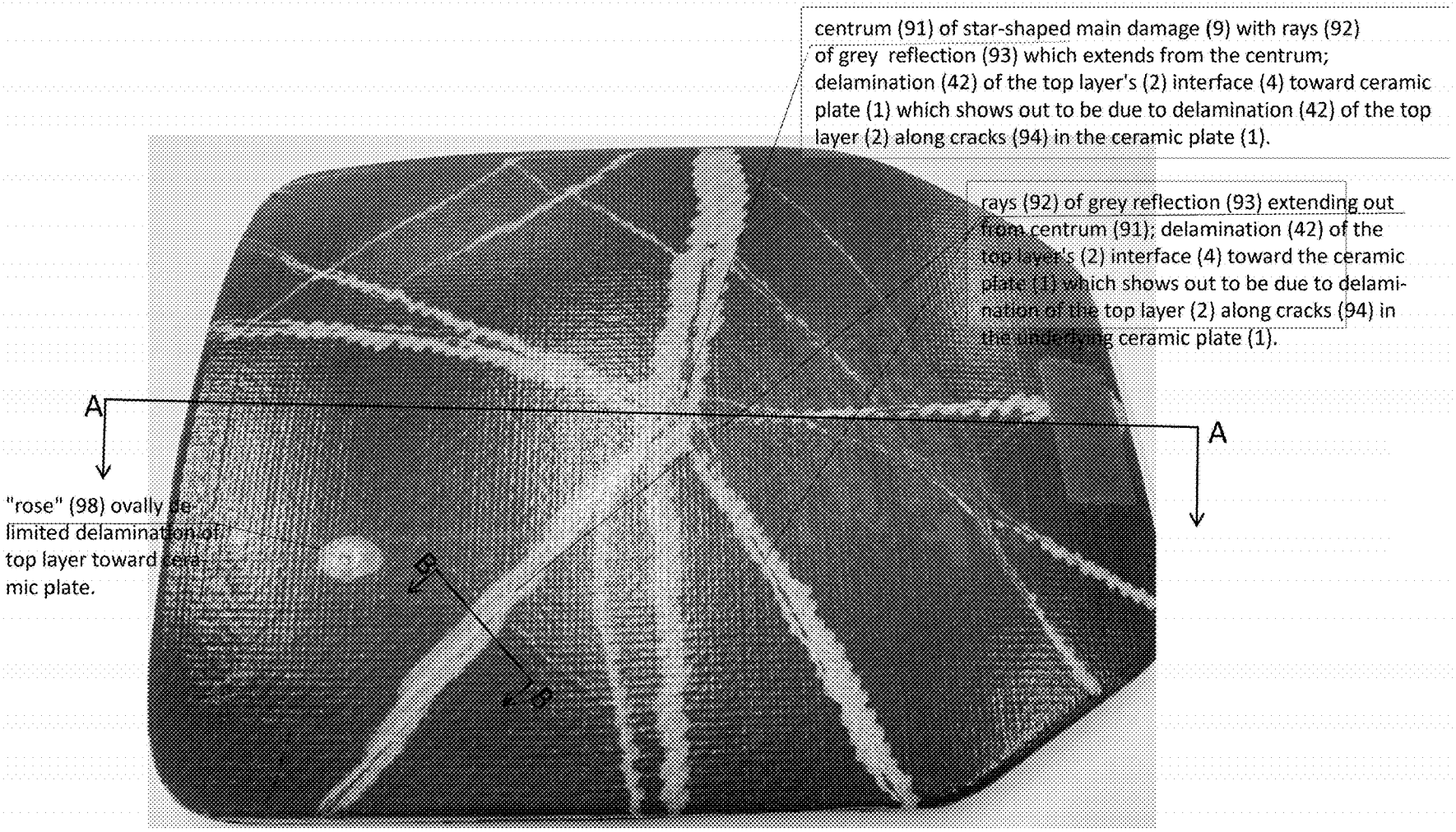
Fig. 1: A damaged antiballistic plate according to an embodiment of the invention. Cracks are rendered indirectly as visible dislocations in and below the top layer.

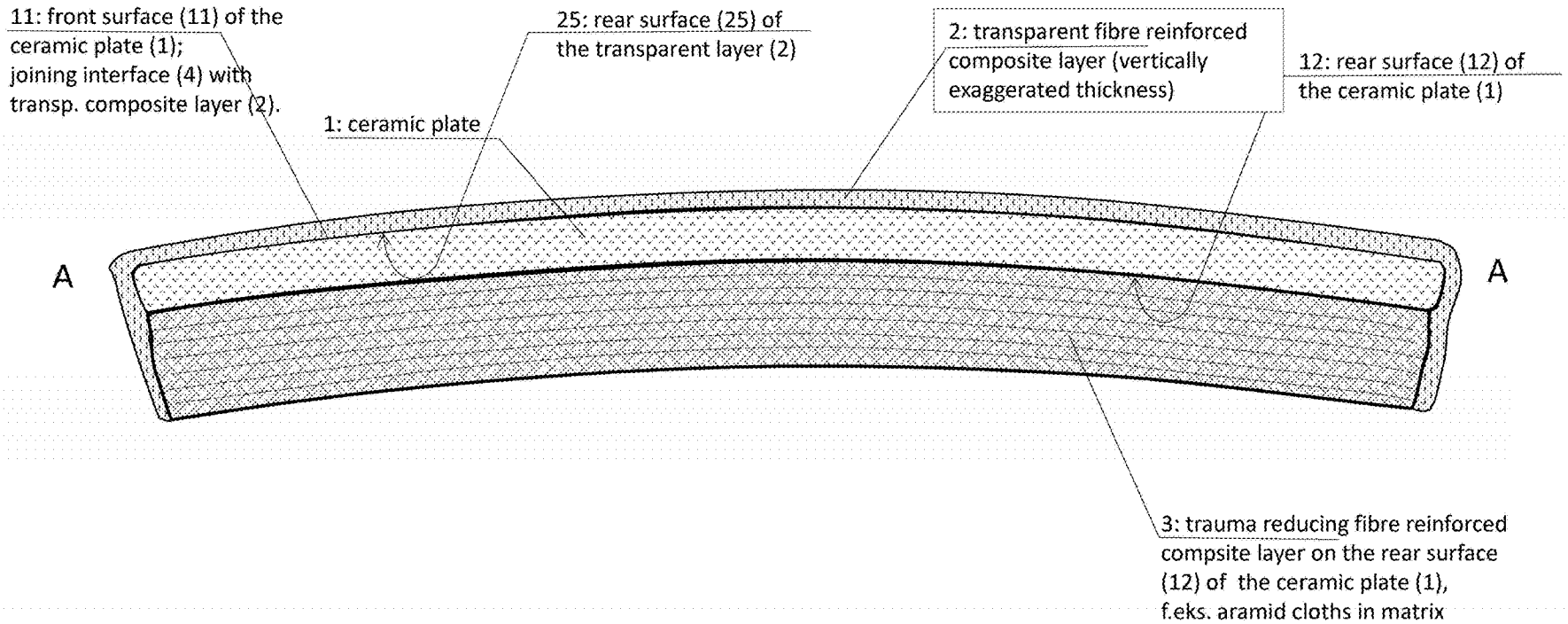
Fig. 2: section along an antiballistic plate according to an embodiment of the invention, before damage

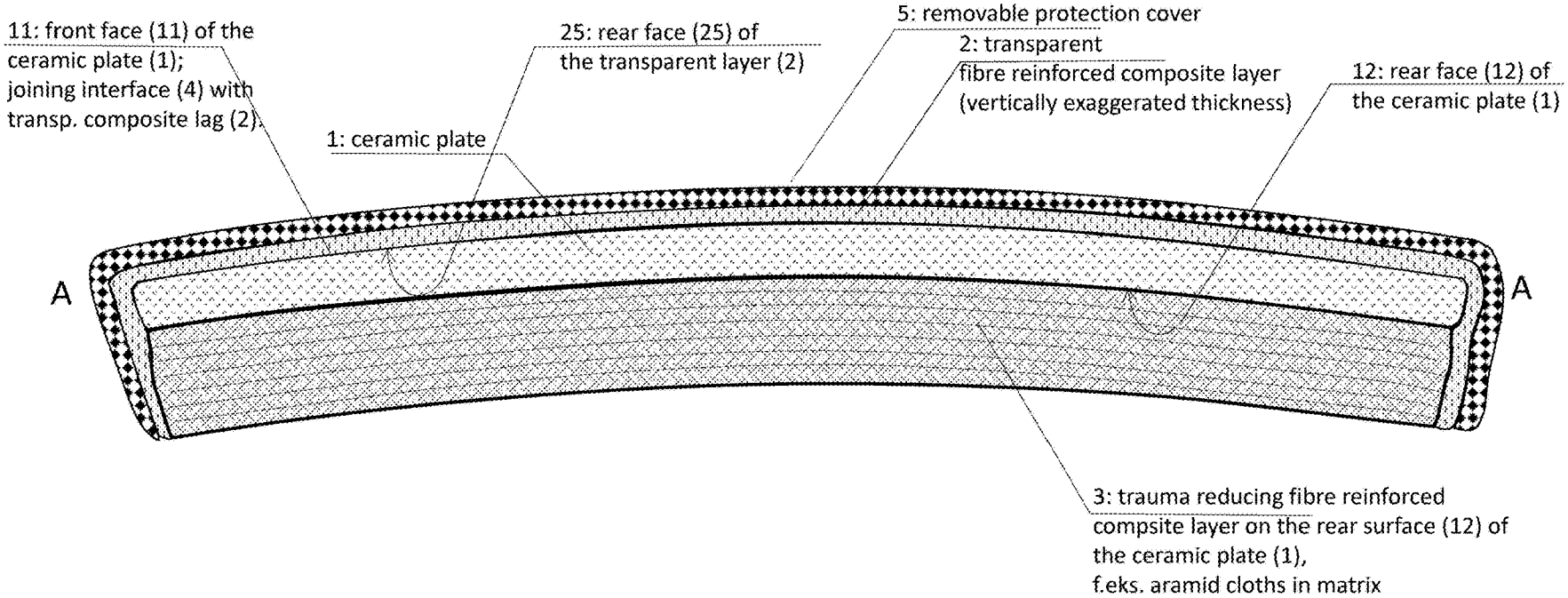
Fig. 3: imagined section along A-A of the antiballistic panel of Fig. 1, before crushing of the antiballistic plate here with a protection cover (5).

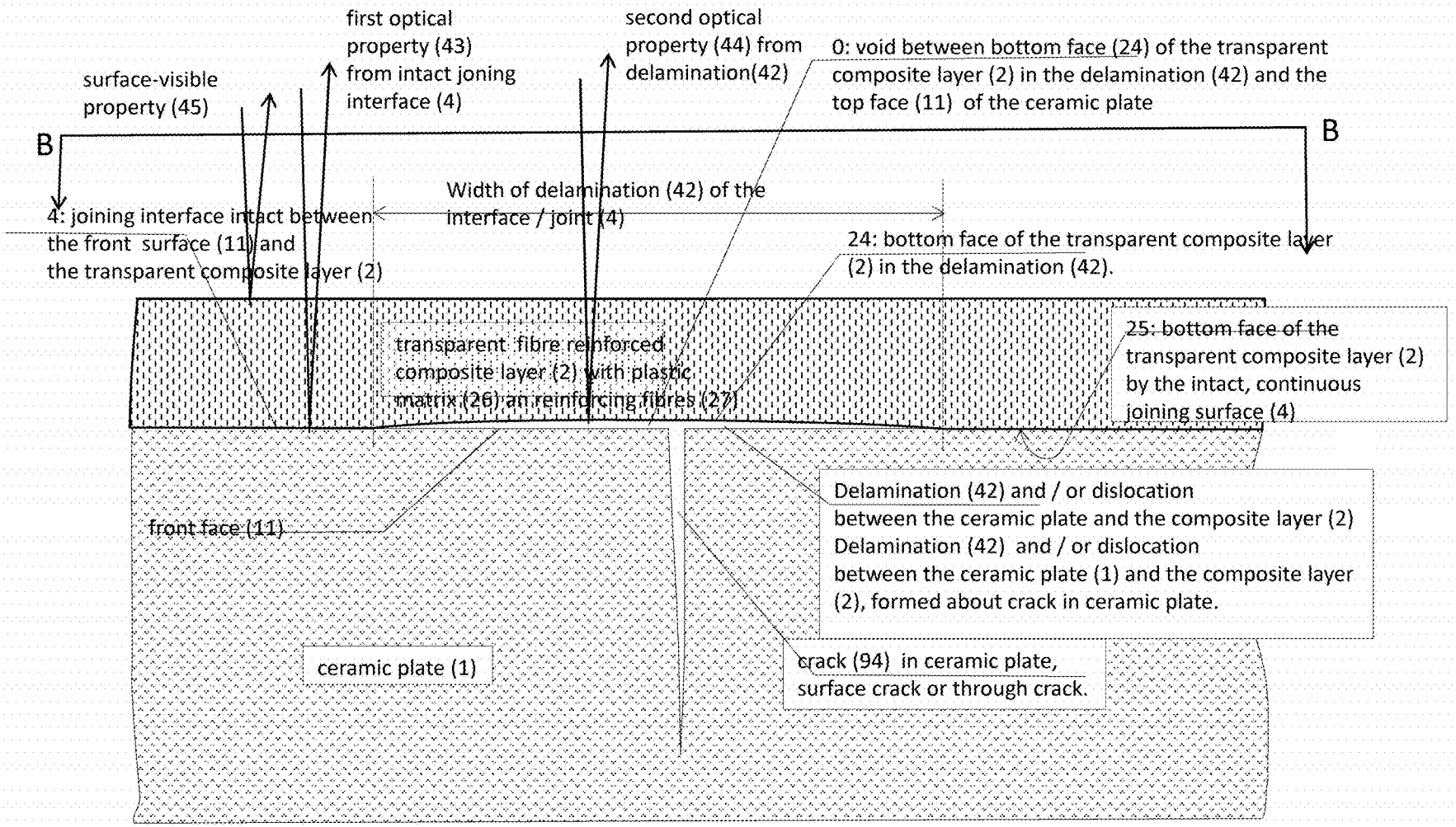
Fig. 4: imagined section B-B of Fig. 1, enlarged, along the antiballistic plate according to an embodiment of the invention (trauma reducing backing (3) not shown)

ANTIBALLISTIC PANEL ARRANGED FOR OPTICAL INSPECTION AND METHOD THEREOF

FIELD OF THE INVENTION

The present invention relates to an antiballistic panel. More specifically, the invention relates to an antiballistic panel that can be visually detected to verify the integrity of its ceramic plate.

BACKGROUND OF THE INVENTION

It is known to use antiballistic plates in bulletproof vests to stop and/or deform projectiles from gunshots, shell splints, and other fragments that occur during shootings and explosions. Inspection of such plates that are made of ceramic core enclosed by a fibre-reinforced composite layer proceeds by ultrasound together with associated analyser. The inspection is done by sending ultrasound signals from a transducer into and through the antiballistic plate where they are then detected by another or the same transducer. According to one method, four ultrasonic transducers are used which send and receive ultrasonic signals. If the ceramic in an antiballistic plate is damaged by the formation of cracks, the cracks in the plate will reflect the ultrasonic signals at the line of fracture. This will give a different reflection pattern than that of an undamaged plate. Inspection of such plates includes testing by ultrasound before use or in association with routine control. It is a major disadvantage for users in close field-situations to inspect the antiballistic plates by this method in that it requires ultrasonic equipment and analyser, expertise in using this and time to perform the control. Preferably, more thorough analyses of the quality of the plate are performed in laboratory, or ultrasound analysis equipment is brought along to the front. The method is expensive and not applicable for field use. Therefore, there is a need for a method for inspection of antiballistic plates for bulletproof vests that are instrument-free, efficient and applicable in the field.

SUMMARY OF THE INVENTION

The invention is defined in the independent claims appended hereto. Embodiments of the invention are defined in the dependent claims.

DESCRIPTION OF FIGURES

Embodiments of the invention will now be described in more detail with reference to the accompanying figures, in which:

FIG. 1 shows a photograph of a damaged antiballistic plate according to an embodiment of the invention.

FIG. 2 shows an imaginary cross-section along A-A shown in FIG. 1, of an undamaged antiballistic plate, according to an embodiment of the invention.

FIG. 3 shows an imaginary cross-section along A-A shown in FIG. 1, of an undamaged antiballistic plate, according to an embodiment of the invention.

FIG. 4 shows an imaginary cross-section along B-B in FIG. 1, enlarged, along a portion of the antiballistic damaged plate according to an embodiment of the invention.

DESCRIPTION OF EMBODIMENTS OF THE INVENTION

With reference to FIG. 1, cracks in the ceramic plate 1 are shown as visible dislocations in and below the top layer. The top layer is a surface layer which is a transparent fibre-reinforced composite layer 2. In the illustrated embodiment, a black boron carbide $B_4C$-plate 1 is used. In those areas where the interface of the ceramic plate against the substantially transparent fibre-reinforced composite top layer 2 is not intact, the reflection is close to light grey or white. The reflectivity of these damaged areas is clearly different from the reflectivity of those areas where the interface is intact, where the reflection is more or less black, ergo one is looking more or less directly at the black boron carbide plate.

The invention is an antiballistic plate comprising the following features:

- a ceramic plate 1 adapted to deform and curb an incoming projectile from a handgun, e.g. a 7.62 rifle shot, or machine gun shot. The ceramic plate 1 must be hard and of high density, and is usually made by sintered boron carbide, silicon carbide or the like, so that, upon impact of projectiles, it deforms and breaks up the surface thereof even though the projectile damages the ceramic. The thickness of the plate depends on which projectiles and projectile velocities are likely to be present in combat situations. One can also imagine that the incoming projectile is shell splinters and similar fragments from an explosion.

Furthermore, the plate has a transparent fibre-reinforced surface composite layer 2 of plastic matrix 26 and reinforcement fibre 27 which is arranged covering on in the essential entire part of a front surface 11 of the ceramic plate 1, and

- a fibre-reinforced trauma-reducing composite layer 3 arranged covering on in the essential a back surface 12 of the ceramic plate 1, wherein the transparent fibre-reinforced surface composite layer 2 forms a continuous joint 4 towards the front surface 11 and has a basically first optical property 43 visible through the transparent fibre-reinforced surface composite layer 2 where the joint 4 is intact, and where the joint 4 towards the front surface 11 has a second optical property 44 visible through the transparent fibre-reinforced surface composite layer 2 where the joint 4 is locally broken and a local delamination 42 is formed.

In one embodiment of the invention, the plastic matrix 26 is transparent in daylight or approximately daylight. In one embodiment of the invention, the reinforcement fibres 27 are also transparent in daylight or approximately daylight.

In one embodiment of the invention, the refraction index ($\lambda$2) of the reinforcement fibres 27 is substantially similar to the refraction index ($\lambda$1) of the plastic matrix 26. This means that the transparent matrix-wet reinforcement fibres 27 in the transparent plastic matrix 26 do not form any particular internal light refraction, and thus the fibre-reinforced surface composite layer 2 is perceived as good as completely transparent on the ceramic plate 1, and the web structure of the reinforcement fibre 27-cloth in itself becomes almost invisible within the transparent fibre-reinforced surface composite layer 2, although the transparent fibre-reinforced surface composite layer 2 usually gets a somewhat uneven surface structure due to the weave in the fibre-reinforcement 27 appears with a somewhat higher surface area than the matrix at intervals in the weave, see FIG. 1.

In one embodiment of the invention, the front surface 11 of the ceramic plate 1 is substantially black. In a more specific embodiment, the ceramic plate 1 is mainly made out of boron carbide $B_4C$ which is substantially black, see the photo in FIG. 1. This material appears, when covered with full contact, a joint or interface 4 to a transparent matrix 26, to be black in daylight.

In one embodiment of the invention, the plastic matrix 26 in the transparent fibre-reinforcement surface composite layer 2 is a polyester, that is, a thermosetting resin. In another embodiment of the invention, the plastic matrix 26 in the transparent fibre-reinforcement composite layer 2 is a PET, i.e. a thermoplastic, and both can be made transparent.

According to an embodiment of the invention, the antiballistic plate can be made with reinforcement fibres 27 of glass fibres and wherein the glass fibres are preferably seized with an adhesive forming agent between the reinforcement fibres 27 and the plastic matrix 26. This makes the transparent fibre reinforcement surface composite layer 2 highly tensile strong but more ductile than the material of the ceramic plate 1. Thus, the transparent fibre-reinforcement surface composite layer 2 can hold the ceramic plate 1's fragments in place even if the plate 1 is completely or partially crushed. This also means that if a crack 41 occurs in the ceramic plate 1, see FIG. 1, the plate will appear as shape-intact in its exterior, and will continue to provide some protection at least against incoming splinters.

The pretext of the invention was that the inventors had produced an antiballistic panel with a black boron carbide plate 1 originally covered by a transparent fiberglass reinforcement composite layer on the front surface 11. We usually use white ceramic antiballistic plates but here we used a black. Notwithstanding anything other than mechanical strength and structural unit, we laminated the antiballistic panel with a transparent surface fibre reinforcement composite layer 2 with plastic matrix 26 of PET and reinforcement fibre 27 of fiberglass 27, see FIG. 4. The antiballistic panel was subjected to shooting in the test bench, and the areas around the stroke impacts, where the boron carbide plate 1 itself is penetrated and gets a broken edge zone, the composite layer becomes greyish and brighter for approximately 1-2 cm edge around the impacts. We also observed some greyish, light lines radiating out from some impacts and assumed that this could be due to a similar effect that indicated cracks in the ceramic plate itself that reflected as grey slip zones in the interface towards the top layer, i.e. a form of delamination of the top layer of the transparent fibre-reinforced surface composite 2 along the cracks. This may be due to either lighter reflection from the air layer 0 upon damage, or to internal reflection between sheared glass fibre and matrix where there is air here and there occasionally. The inventors assumed that a similar effect could also apply to non-shot plates that have been subjected to impact damage; soldiers sometimes lose antiballistic plates on concrete floors, stones, stairs, steel decks, or other hard surfaces or sharp edges, or they fall on hard objects by accident. In one embodiment, the invention also includes a detachable protective cover 5 which is intended to protect during transport, falling and minor impact or stroke.

We then made an antiballistic panel with a ceramic plate black boron carbide and laminated it with a top layer of transparent fibre-reinforcement surface composite 2 of fiberglass-reinforcement 27 transparent matrix 26 and a trauma-reducing fibre-reinforced composite layer 3 on the backside as defined in the invention. Then we exposed the antiballistic panel to a hammer stroke, wherein one of the strokes only damaged the top layer of transparent fibre-reinforced surface composite, and leaving a "rose" 98 in it, see FIG. 1, but where a subsequent and much harder hammer stroke in the middle of the panel formed what we for FIG. 1 calls a main damage 9 with rays of grey reflection 93 extending from the centre 91 of the main damage 9 and forming a main beam pattern from the centre 91 of the main damage 9 in the panel. We have examined the ceramic plate 1 in the areas along the light parts and found that cracks 94 in the ceramic plate 1 are repeated as visible delamination's 42 both within and below the transparent composite layer, i.e. the top layer of transparent fibre-reinforced surface composite 2.

The degree of transparency of the transparent fibre-reinforcement composite layer 2 is due to similarity in refraction index of the glass fibre 27 and the plastic matrix 26, the more similar, the less internal light refraction between glass and matrix. Crucial to this is that the fiberglass filaments are inserted with a sizing, a coating that ensures adhesion between the two completely different material components glass and plastic such as PET. There is fiberglass with special sizing that matches a special polyester matrix (thermosetting plastic), but with the used thermoplastic PET and fiberglass as illustrated in the photo in FIG. 1, the transparent properties are fully sufficient.

Attempts have also been made to use white ceramic plates and the distinction between a substantially glossy, even white reflection over intact interface, joint 4 and a more fuzzy and greyer delamination 42 around the cracks is clearly visible. Silicon carbide ceramic plates are also used. Boron carbide plates are 5-10× the price of white ceramic plates 1 and it is therefore interesting to know if the expensive ceramics are cracked or whole.

The invention also encompasses a method of making the optically detectable antiballistic plate. The invention is a method of making an optically detectable antiballistic plate, comprising the following steps:

- producing a composite arrangement comprising
  - a ceramic plate (1),
  - a fibre-reinforced surface composite layer (2) of plastic matrix (26) and reinforcement fibre (27) arranged covering on in the essential entire of a front surface (11) of the ceramic plate (1), and that at setting of the matrix makes the surface composite layer (2) transparent, and
  - a fibre-reinforcement trauma-reducing composite layer (3) arranged covering on in the essential a back surface (12) of the ceramic plate (1),
- appliance of the composite arrangement in a vacuum bag, and vacuum casting of the composite arrangement with subsequent removal from the vacuum bag,
- so that the resulting transparent fibre-reinforcement surface composite layer (2) forms a continuous joint (4) towards the front surface (11) and has a basically first optical property (43) visible through the transparent fibre-reinforced surface composite layer (2) where the joint (4) is intact, and wherein the joint (4) towards the front surface (11) obtains a second optical property (44) visible through the transparent fibre-reinforcement surface composite layer (2) where the joint (4) locally is broken and a local delamination (42) is formed.

All of the embodiments described above can be formed as further features of this method.

Thus, the ceramic plate 1 is coated with a transparent fibre-reinforced surface composite layer 2 of plastic matrix 26 and reinforcement fibre 27. This layer is arranged covering on in the essential the entire of a front surface 11 of the ceramic plate 1, but can also cover the composite layer (3) at the back side, see below. At the back side of the ceramic plate 1, a fibre-reinforcement trauma-reducing composite layer 3 is arranged on in the essential a back surface 12 of the ceramic plate 1. This is covered in outer layer of plastic, preferably layer 2 above. A vacuum bag must be used, which creates a vacuum, when heat treating the ceramic plate 1 for heating, melting and cooling, setting of the thermoplastic matrix as PET, possibly curing polymer plastic during heat treatment.

The invention claimed is:

1. An antiballistic plate comprising:

a ceramic plate arranged to deform and curb an incoming projectile;

a transparent fibre-reinforced surface composite layer of plastic matrix and reinforcement fibres that is arranged covering on in the essential the entire of a front surface of the ceramic plate; and a fibre-reinforced trauma-reducing composite layer arranged covering on in the essential a back surface of the ceramic plate, wherein the transparent fibre-reinforced surface composite layer forms a continuous joint towards the front surface and has a basically first optical property visible through the transparent fibre-reinforced surface composite layer where the joint is intact, and wherein the joint towards the front surface obtains a second optical property visible through the transparent fibre-reinforced surface composite layer where the joint locally is broken and a local delamination is formed.

2. The antiballistic plate according to claim 1, wherein the plastic matrix is transparent in daylight or approximate daylight.

3. The antiballistic plate according to claim 2, wherein the reinforcement fibres are transparent in daylight or approximately daylight when intact in the plastic matrix.

4. The antiballistic plate according to claim 3, wherein a refraction index of the reinforcement fibres is substantially similar to a refraction index of the plastic matrix.

5. The antiballistic plate according to claim 1, wherein the front surface of the ceramic plate is substantially black.

6. The antiballistic plate according to claim 1, wherein the ceramic plate is formed mainly of boron carbide $B_4C$.

7. The antiballistic plate according to claim 1, wherein the plastic matrix of the transparent fibre-reinforced surface composite layer is polyester or PET.

8. The antiballistic plate according to claim 1, wherein the reinforcement fibres comprise glass fibres seized with an agent forming adhesion between the reinforcement fibres and the plastic matrix.

9. The antiballistic plate according to claim 1, wherein the first optical property initially is black and glossy evenly reflective.

10. The antiballistic plate according to claim 1, wherein the second optical property is grey rugose or unclear reflective.

11. A method of making an optically detectable antiballistic plate, comprising the following steps:

producing a composite arrangement comprising:

a ceramic plate;

a fibre-reinforced surface composite layer of plastic matrix and reinforcement fibre that is arranged covering on in the essential the entire of a front surface of the ceramic plate, and when setting the matrix makes the surface composite layer transparent; and a fibre-reinforced trauma-reducing composite layer arranged covering on in the essential a back surface of the ceramic plate; and appliance of the composite arrangement in a vacuum bag, and vacuum casting of the composite arrangement, with subsequent removal from the vacuum bag, so that the resulting transparent fibre-reinforced surface composite layer forms a continuous joint towards the front surface and has a basically first optical property visible through the transparent fibre-reinforced surface composite layer where the joint is intact, wherein the joint towards the front surface obtains a second optical property visible through the transparent fibre-reinforced surface composite layer where the joint locally is broken and a local delamination is formed.

12. The antiballistic plate according to claim 2, wherein the front surface of the ceramic plate is substantially black.

13. The antiballistic plate according to claim 3, wherein the front surface of the ceramic plate is substantially black.

14. The antiballistic plate according to claim 4, wherein the front surface of the ceramic plate is substantially black.

15. The antiballistic plate according to claim 2, wherein the ceramic plate is formed mainly of boron carbide $B_4C$.

16. The antiballistic plate according to claim 3, wherein the ceramic plate is formed mainly of boron carbide $B_4C$.

17. The antiballistic plate according to claim 4, wherein the ceramic plate is formed mainly of boron carbide $B_4C$.

18. The antiballistic plate according to claim 5, wherein the ceramic plate is formed mainly of boron carbide $B_4C$.

19. The antiballistic plate according to claim 2, wherein the plastic matrix of the transparent fibre-reinforced surface composite layer is polyester or PET.

20. The antiballistic plate according to claim 3, wherein the plastic matrix of the transparent fibre-reinforced surface composite layer is polyester or PET.

* * * * *